US005959527A

United States Patent [19]

Beder et al.

[11] Patent Number: 5,959,527

[45] Date of Patent: Sep. 28, 1999

[54] TIME TRIGGERED CHIME

[75] Inventors: Samuel L Beder, Cape Elizabeth; Alan Beder, Portland, both of Me.

[73] Assignee: Woodstock Percussion, Inc., West Hurley, N.Y.

[21] Appl. No.: 08/861,861

[22] Filed: May 22, 1997

[51] Int. Cl.[6] ..... G08B 3/00

[52] U.S. Cl. ..... 340/392.4; 340/384.71; 340/392.5; 340/692; 368/75; 368/272; 368/108; 368/273

[58] Field of Search ..... 340/392.4, 384.7, 340/384.71, 392.5, 692; 368/243, 273, 108, 272, 72–75

[56] References Cited

U.S. PATENT DOCUMENTS

| | | | |
|---|---|---|---|
| 0,988,338 | 4/1911 | Herschede | 368/273 |
| 2,270,085 | 1/1942 | Schwinzer | 340/392.5 |
| 3,520,126 | 7/1970 | Kolodziej | 368/75 |
| 3,778,997 | 12/1973 | Jauch | 368/75 |
| 3,943,700 | 3/1976 | Hummel et al. | 368/243 |
| 4,357,692 | 11/1982 | Broghammer et al. | 368/75 |
| 4,482,260 | 11/1984 | Fehrenbacher | 368/180 |
| 5,208,578 | 5/1993 | Tury et al. | 340/392.3 |
| 5,369,391 | 11/1994 | Gadsby | 340/392.5 |

*Primary Examiner*—Jeffery A. Hofsass
*Assistant Examiner*—Benjamin Lee
*Attorney, Agent, or Firm*—Charles J. Brown

[57] ABSTRACT

A chime activated by a clock to sound a pleasing sound every hour, by attaching a clock to an electrical controller that operates a striker mechanism. The striker mechanism, comprising a striker ball that strikes the chime elements when rotated provides an uniquely pleasing sound. The invention also includes means of disconnecting the sound independent of clock operations as well as chime activation for a varying period or a varying number of striker rotations to provide auditory indication of the time.

6 Claims, 3 Drawing Sheets

TIME TRIGGERED CHIME

FIELD OF INVENTION

This invention relates to musical chimes, and particularly to a chime whose operation is triggered by a clock.

BACKGROUND OF THE INVENTION

From ancient times audible signals were used to indicating the passage of time, varying from ship bells every half an hour through the classic mechanical grandfather clock to today's digital watches that indicate a full hour with a short sound. Therefor, the activation of an audio signal at given times is well known. However that same tone is in many cases distinct and distracting. Bells or electronic alarms command attention by their nature. And while the need to command attention was imminent in times past, today, with the ready availability of time sources, commanding attention is not required in many instances. However the esthetically pleasing effects of regular indication of passage of time is still desired by many.

Electrical and mechanical clocks capable of producing an electrical signal, either a pulse or a switch closure, at every hour or half-hour are readily available. Common electrical design principles make it obvious to create a clock that will generate a number of pulses every hour, commensurate with the number of hours, i.e. one pulse for one o'clock, two pulses for two o'clock, etc.

Wind chimes have been used for centuries for their pleasing musical effects. Unlike gongs and bells they seem to allow continuous sound that is clearly audible but that does not distract people from daily activities. Chimes operate frequently at night without disturbing sleep of nearby persons, as compared to the jarring effect of a bell or an electronic alarm. U.S. Pat. No. 5,208,578, Tury et al. teaches a solar powered chime, operated by a mechanical striker in a random fashion to simulate a wind chime indoors.

SUMMARY OF THE INVENTION

The present invention supplies the pleasing auditory effect of time passage reminder without the distracting nature of harsh audible indicators. The invention achieves that by combining a clock and a mechanized chime.

The invention is embodied by a clock capable of activating an electrical mechanism at given time intervals such as every hour. The electrical mechanism is used to strike, rotate, or otherwise operate chimes to produce sound at regular intervals.

It is also an object of the invention to provide time indication proportional to the current hour by varying the period of audible signal in accordance with the indicated time. As can be seen in the detailed description that follows this objective is easily achieved by utilizing a microcontroller as a part of the electrical mechanism described above.

DETAILED DESCRIPTION OF THE INVENTION

Figure 1:
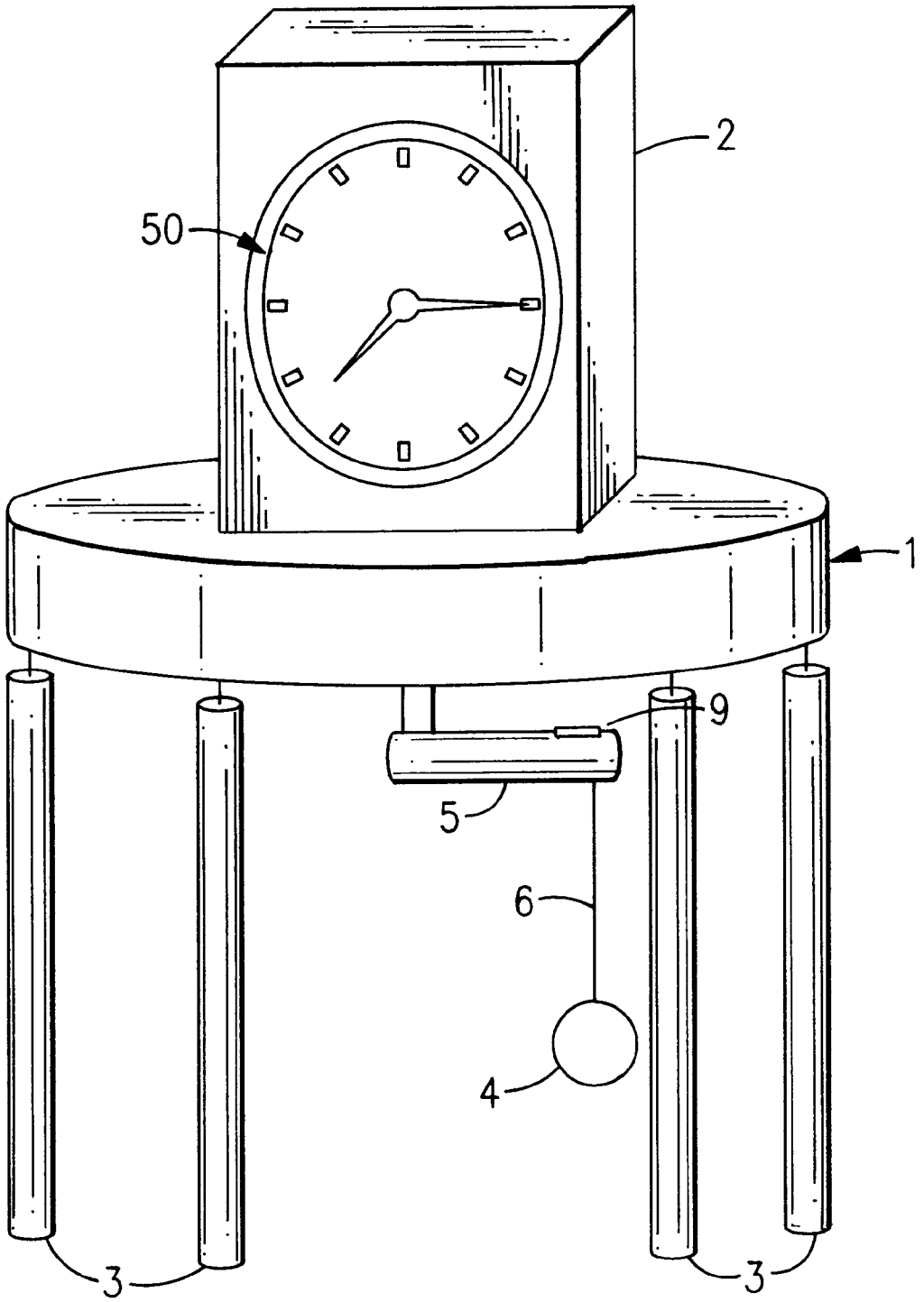
FIG. 1: perspective view of the preferred implementation.
Figure 2:
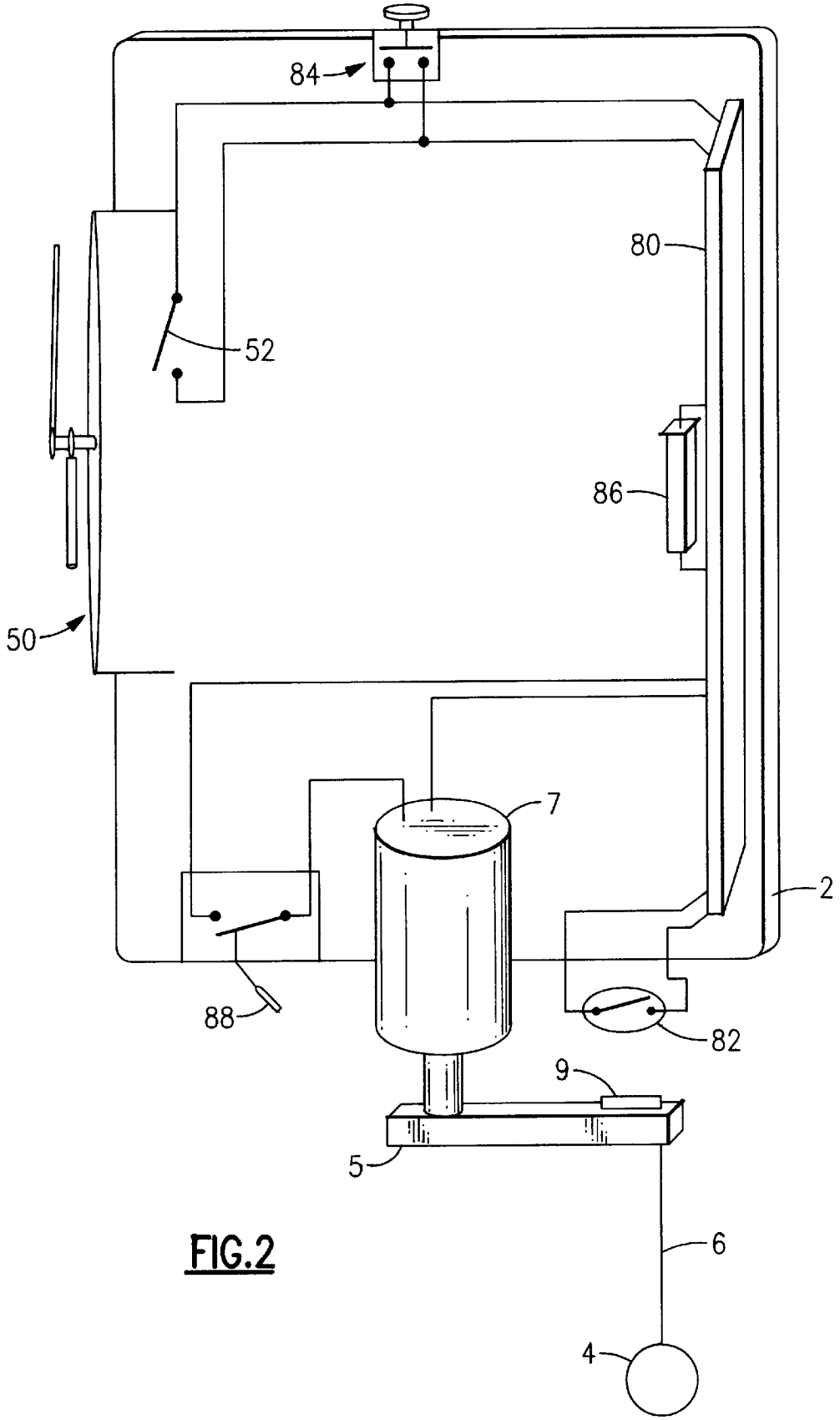
FIG. 2: cutaway of clock housing showing mechanical arrangement of pertinent parts.
Figure 3:
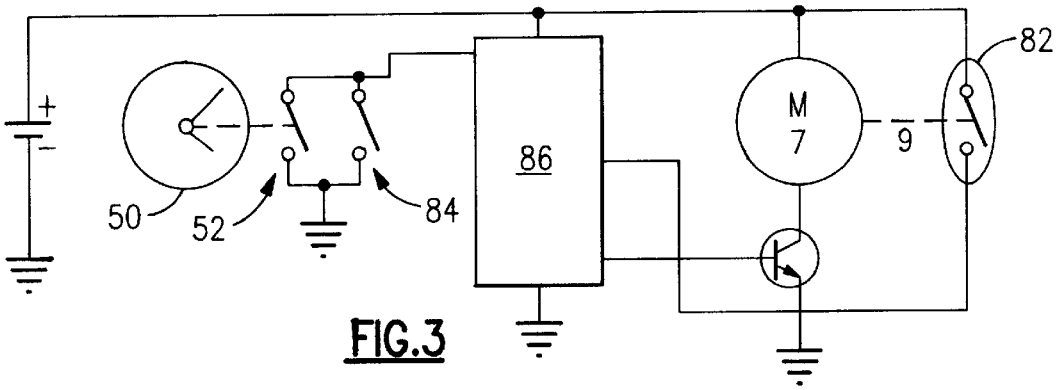
FIG. 3: block schematic diagram of preferred implementation.

The preferred implementation of the invention utilizes a chime composed of a base 1 with a plurality of individual Sound Producing Members (SPM hereinafter) 3 flexibly suspended from base 1 and arranged generally so that a striker assembly can strike the SPM to produce sound. A clock housing 2 is located above the base 1, and houses a clock mechanism 50, a chime activating controller 80, and other supporting circuitry such as activating and adjusting switches. The clock housing 2 also houses an electric motor 7 mounted so that the motor shaft extends outside the lower portion of the clock housing 2. A striker assembly is attached to the motor shaft.

The striker assembly in the preferred implementation comprises an activating link 5 attached to motor 7 shaft. A striker ball 4 is suspended by a string 6, from activating link 5. The string is attached to activating link 5 at the end opposite the motor shaft. When the motor rotates, it rotates the ball 4 which in turn impacts the SPM 3.

The preferred implementation utilizes a clock mechanism 50, equipped with a trigger contact 52. The clock mechanism activates the trigger contact 52 to provide an activating pulse every hour, and that pulse is used as an input to chime controller 80 which in turn activates the striker assembly to sound the chime for a variable period proportional to the hour.

Figure 4:
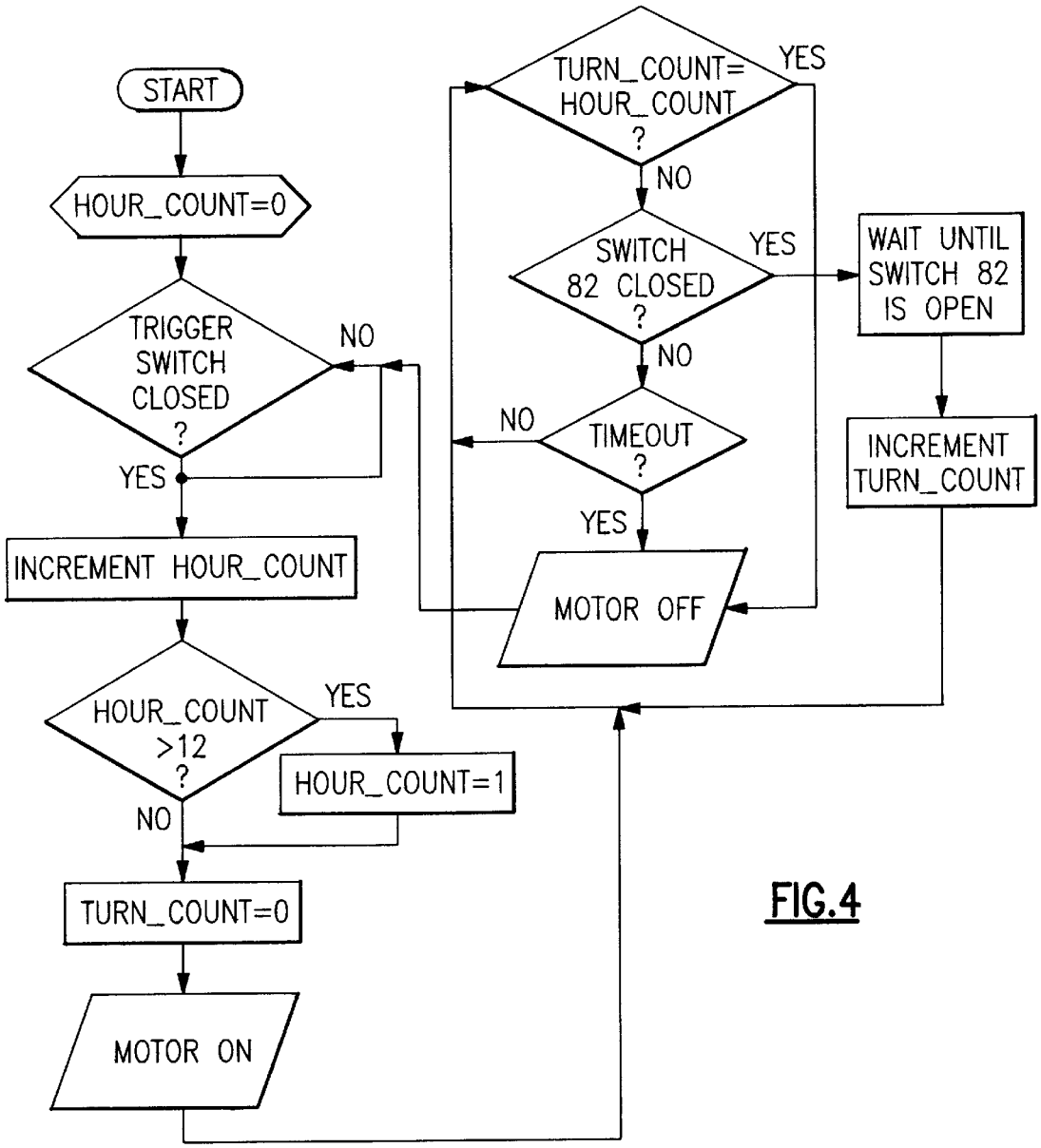
FIG. 4: an operational algorithm for chime activating controller.

The chime controller 80 selected for the preferred implementation utilizes a programmable microcontroller 86. The clock trigger pulse from trigger contact 52 is sensed by the microcontroller 86 and is used to energize a motor 7 under program control (please refer to FIG. 4 for general operating algorithm). The motor in turn rotates the striker assembly. A magnet 9, attached to activating rod 5, which rotates with the striker assembly, closes a magnetic reed switch 82 once per turn of the striker assembly. The microcontroller 86 utilizes those switch closures to count the number of turns the striker assembly performs, and keeps the motor turning until the desired number of turns occurs. The operating programs of the microcontroller 86 increases the number of turns for each clock trigger pulse, until it reaches twelve turns. Then the number of turns resets to one. This creates an auditory time indication proportional to the indicated hour.

The preferred implementation also includes a switch 88 capable of disconnecting the motor, so that the chime operation may be muted without disturbing the clock operation. In this case, the operating program senses the fact that the motor is not operating by the lack of closure of switch 82, and times out after a predetermined time. The operating program than reverts to waiting for the next clock trigger pulse.

Variations on the invention are numerous, and include amongst others the use of an electronic clock module that generates the required signals to drive the motor as part of its integral electronics, thus eliminating the need for a separate control board and electronics. Similarly, a solenoid can activate the chime either with or without a striker assembly. Other variations will include the addition of alarm, and similar functions commonly expected from a clock.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

We claim:

1. A time activated chime comprising a) a base;

b) a plurality of resonating elements flexibly suspended from said base;

c) a striker assembly adapted to affect energy onto said resonating elements; and d) a clock mechanism adapted to provide an electrical trigger signal at preset time intervals and activate said striker assembly comprising i. an electrical motor adapted to rotate said striker assembly, and ii. an electrical controller adapted to activate said motor in response to said electrical trigger signal; and e) a sensing mechanism connected as input to said electrical controller to sense the number of turns the striker assembly performs; and f) said electric controller being adapted to utilize said sensing mechanism input to count turns of said striker assembly and activate said motor for varying the number of turns of said striker assembly in response to said electric trigger signal.

2. A time activated chime comprising a) a base;

b) plurality of resonating elements flexibly suspended from said base;

c) a clock mechanism adapted to provide an electric trigger signal at preset time intervals;

d) an electrical controller constructed to accept said electrical trigger signal and capable of activating an electrical motor in response to said electrical trigger signal;

e) an electrical motor having a rotatable shaft connected to said electrical controller; and f) a striker assembly comprising i. an activating arm having a first end and a second end connected to the shaft of said electrical motor in proximity to said first end, and ii. a striker ball flexibly suspended from said activating arm in proximity to said second end constructed to allow said striker ball to strike said resonating elements when said activating arm is rotated.

3. A time activated chime comprising a) a base, b) a plurality of resonating elements flexibly suspended from said base, c) a housing attached on top of said base, d) a clock mechanism located in said housing adapted to provide an electrical trigger signal at preset time intervals, e) a programmable electrical controller constructed to accept said electrical trigger signal and capable of activating an electrical motor under program control in response to said electrical trigger signal, f) An electrical motor having a rotatable shaft connected to said electrical controller, g) an activating arm having a first end and a second end connected to said shaft of said electrical motor in proximity to said first end and rotatable by said motor, and h) a striker ball flexibly suspended from said activating arm in proximity to said second end and placed to allow said striker ball to strike said resonating elements when said activating arm is rotated.

4. The time activated chime according to claim 3 wherein a magnetically operated switch is fixedly located in proximity to said activating arm and at least one magnet is fixedly attached to said activating arm and located so as to activate said magnetically operated switch at least once for each turn of said activating arm, whereby said programmable electrical controller is adapted to use said activation of said magnetically operated switch to count turns of said activating arm and activate said motor for a number of turns proportional with the time indicated by said clock mechanism.

5. A time activated chime comprising a) a base;

b) a plurality of resonating elements flexibly suspended from said base;

c) a clock mechanism adapted to provide an electrical trigger signal at present time intervals;

d) an electrical controller constructed to accept said electrical trigger signal and capable of activating an electric motor in response to said electric trigger signal;

e) an electric motor having a rotatable shaft connected to said electrical controller;

f) a striker assembly rotated by said electrical motor constructed to impart energy onto said resonating elements when rotated and attached to the shaft of said electrical motor; and g) a sensing mechanism connected as input to said electrical controller to sense the number of turns the striker assembly performs comprising i. a mechanical link attached to the shaft of said electrical motor, ii. a magnetically operated switch placed in proximity to said mechanical link, and iii. a magnet attached to said mechanical link and located to activate said magnetically operated switch in accordance with turns of said striker assembly, h) whereby said electrical controller utilizes said sensing mechanism input to count turns of said striker assembly and activate said motor for varying the number of turns of said striker assembly in response to said electrical trigger signal.

6. The time activated chime of claim 5 wherein said electrical controller comprises a microprocessor capable of activating said electrical motor and programmed to provide activation of said electrical motor for a varying number of turns of said striker assembly.

* * * * *